US006254141B1

(12) United States Patent
Piper

(10) Patent No.: US 6,254,141 B1
(45) Date of Patent: Jul. 3, 2001

(54) ADJUSTABLE LENGTH CLOSET FASTENER AND METHOD

(76) Inventor: Leroy C. Piper, 1923 Holiday La., Naples, FL (US) 33104

( * ) Notice: Subject to any disclaimer, the term of this patent is extended or adjusted under 35 U.S.C. 154(b) by 0 days.

(21) Appl. No.: 09/179,658

(22) Filed: Oct. 27, 1998

(51) Int. Cl.[7] ..... A47K 1/14; E03D 11/13

(52) U.S. Cl. ..... 285/56; 4/252.1; 411/172; 411/120; 285/58

(58) Field of Search ..... 285/56, 57, 58, 285/59, 60; 4/252.1, 419; 411/172, 173, 107, 120

(56) References Cited

U.S. PATENT DOCUMENTS

| | | | | |
|---|---|---|---|---|
| 927,611 | * | 7/1909 | Stallings . | |
| 1,915,640 | | 6/1933 | Alsaker . | |
| 2,236,130 | | 3/1941 | Betebenner | 285/6.5 |
| 2,252,194 | | 8/1941 | Mills | 152/409 |
| 3,028,645 | | 4/1962 | Stearman et al. | 24/68 |
| 3,180,660 | * | 4/1965 | Brewington . | |
| 3,181,585 | * | 5/1965 | Brewington . | |
| 3,340,760 | | 9/1967 | Wormser | 85/8.8 |
| 3,419,298 | * | 12/1968 | Worley | 411/172 |
| 3,905,052 | * | 9/1975 | DeAngelis . | |
| 4,227,722 | * | 10/1980 | Baber | 285/56 |
| 4,233,697 | * | 11/1980 | Cornwall . | |
| 4,850,063 | * | 7/1989 | Abbate . | |
| 4,907,923 | * | 3/1990 | McGrath | 411/107 |
| 4,928,531 | * | 5/1990 | Schult et al. | 411/384 |
| 5,222,851 | * | 6/1993 | Dickerson . | |
| 5,421,036 | * | 6/1995 | Stevens et al. . | |

* cited by examiner

*Primary Examiner*—Eric K. Nicholson
(74) *Attorney, Agent, or Firm*—Edward M. Livingston, Esq

(57) ABSTRACT

An adjustable-length closet fastener (1) has a fastener shank (2, 32) with an anchor-ridge head (3, 33) which is sized and shaped for positioning side walls of the anchor-ridge head against walls (5) of a predetermined retainer cavity (6) to arrest rotation of the fastener shank and which is sized and shaped for positioning a fastener shank-side surface (9) of the anchor-ridge head against a ceiling (10) of the predetermined retainer cavity at opposite sides of a shaft orifice in the predetermined retainer cavity to prevent exit of the adjustable-length closet fastener from the predetermined retainer cavity. A length-adjustment sleeve (11) with internal machine threads (12) is attached to the fastener shank for extension a predetermined distance towards a predetermined fastening position (13). A length-adjustment bolt (16) with external machine threads (17) that match the internal machine threads of the length-adjustment sleeve is screwed a desired length-adjustment distance into the length-adjustment sleeve.

14 Claims, 4 Drawing Sheets

ADJUSTABLE LENGTH CLOSET FASTENER AND METHOD

BACKGROUND OF THE INVENTION

This invention relates to adjustable-length fasteners such as bolts for fastening water closets for toilets and the like to floors and walls.

Fastening water closets such as toilets and urinals is accomplished conventionally with a fastener T-bolt having a flat T-head that is inserted into a T-slot in a base of toilet bowl or urinal. A threaded shank of the T-bolt is extended upwardly through a floor or horizontally through a wall from the base to where a fastener nut is threaded onto the threaded shank. An aesthetic cover such as a hollow cone is positioned over the fastener nut and a portion of the threaded shank that extends beyond the fastener nut.

However, the problem with the conventional closet fasteners occurs from the length of the threaded shank which must be sufficiently long to extend upward through flooring, whether the flooring be thick tiles or thin vinyl or thin tile. Being long enough for extension through the thickest of flooring leaves typically an excess length of approximately an inch of threaded shaft that must be cut off after the bowl is positioned and sealed in place in order for typical aesthetic covers to be positioned over the threaded shank and fastener nut while a base of the aesthetic cover is positioned against a surface of the base of the toilet bowl or urinal. Cutting off the excess length takes considerable time and care to accomplish without disrupting the seal or positioning of the bowl. It is a fatigue factor to this aspect of plumbing. Providing fastener T-bolts that are the right length is not practical because there are so many unforeseeable variables in floor thicknesses.

A known attempt to solve this problem was a joint and telescoping bolt assembly described in U.S. Pat. No. 3,419,298, issued to Worley on Dec. 31, 1968. Different from an internally threaded length-adjustment sleeve and an externally threaded length-adjustment bolt of the present invention, the Worley device was limited to a telescopic member that was threaded both internally and externally.

No other known prior art addresses and solves this problem with sufficient similarity to the present invention to merit comparison or citation.

Bolt-length problems of fastening closets to floors and walls have continued to exist.

SUMMARY OF THE INVENTION

In light of these problems, objects of patentable novelty and utility taught by this invention are to provide an adjustable-length closet fastener which:

- Is quickly and easily adjustable in length to match floor and wall thickness;
- Does not need to be cut short for thin flooring and walls; and
- Avoids a present problem of loosening and unsealing closet flanges when cutting fastener bolts.

This invention accomplishes these and other objectives with an adjustable-length closet fastener having a fastener shank with an anchor-ridge head which is sized and shaped for positioning side walls of the anchor-ridge head against walls of a predetermined retainer cavity to arrest rotation of the fastener shank and which is sized and shaped for positioning a fastener shank-side surface of the anchor-ridge head against a ceiling of the predetermined retainer cavity at opposite sides of a shaft orifice in the predetermined retainer cavity to prevent exit of the adjustable-length closet fastener from the predetermined retainer cavity. A length-adjustment sleeve with internal machine threads is connected integrally to the fastener shank for extension a predetermined distance towards a predetermined fastening position. A length-adjustment bolt with external machine threads that match the internal machine threads of the length-adjustment sleeve is screwed a desired length-adjustment distance into the length-adjustment sleeve. A fastener nut with internal machine threads that match the external machine threads of the length-adjustment bolt is screwed onto the length-adjustment bolt proximate the predetermined fastening position and rotated for desired tightness between the Anchor-ridge head and the fastener nut.

The predetermined retainer cavity can be a bolt-down slot in a flange of a water-closet base. The length-adjustment sleeve can be attached rigidly or detachably to the fastener shank. If attached detachably to the fastener shank, the length-adjustment sleeve can have separate rotation-arrestment walls. The length-adjustment bolt can have a grasp handle extended linearly for finger or wrench rotation of the length-adjustment bolt in the length-adjustment sleeve for length adjustment prior to screwing on and tightening of the fastener nut. Whether the length-adjustment sleeve is attached rigidly or detachably to the fastener shank, the fastener nut can be a cap type with a closed end for being employed as a fastener bolt with a head by screwing its full length onto the length-adjustment bolt and rotating the length-adjustment bolt for length adjustment prior to thread-tightening rotation. The fastener nut can optionally be made part of the length adjustment bolt.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are described briefly as follows:

DESCRIPTION OF PREFERRED EMBODIMENT

Figure 1:
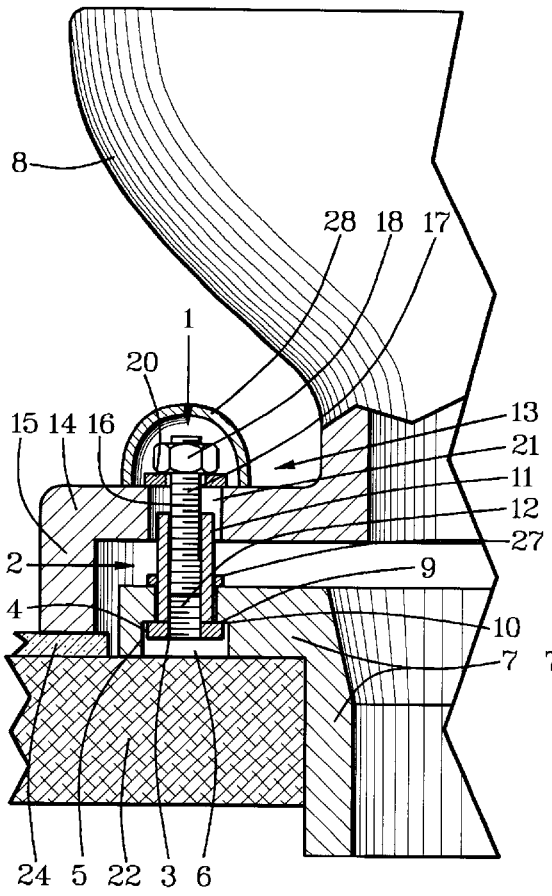
FIG. 1 is a partially cutaway front view of a left side of a fastening portion of a water closet such as a toilet bowl on a floor having thin flooring in relationship to an adjustable-length closet fastener adjusted in length for the thin flooring.

Terms used to describe features of this invention are listed below with numbering in the order of their initial use with reference to the drawings. These terms and numbers assigned to them designate the same features wherever used throughout this description.

1. Adjustable-length closet fastener
2. Fastener shank
3. Anchor-ridge head
4. Sides of anchor-ridge head
5. Walls of bolt-shaft slot
6. Bolt-shaft slot
7. Mating flange for water closet
8. Water closet
9. Fastener shank-side surface
10. Retainment wall
11. Length-adjustment sleeve
12. Internal machine threads
13. Fastening position extension
14. Closet base
15. Closet-base sleeve
16. Length-adjustment bolt
17. External machine threads
18. Fastener nut
19. Fastener cap nut
20. Material-protection washer
21. Closet-base aperture
22. Floor
23. Flange bolts
24. Relatively thin flooring
25. Relatively thick flooring
26. Flange-inlet bays
27. Flange-lock ridge
28. Aesthetic covers
29. Closed end
30. Square grasp-handle extension
31. Hexagonal grasp-handle
32. Separable fastener shank
33. Rotation-arrestment head
34. Rotation-arrestment appendage
35. Flat side
36. Rigid bolt head
37. Wing nut Reference is made first to FIGS. 1–3 of the drawings. An adjustable-length closet fastener 1 has a fastener shank 2 with an anchor-ridge head 3 that is sized and shaped for positioning of sides 4 of the anchor-ridge head 3 against walls 5 of a bolt-shaft slot 6 in a mating flange 7 for a water closet 8 to arrest shaft rotation of the fastener shank 2. The fastener shank 2 is sized and shaped also for positioning a fastener shank-side surface 9 of the anchor-ridge head 3 against a retainment wall 10 proximate the bolt-shaft slot 6 to prevent exit of the adjustable-length closet fastener 1 from the bolt-shaft slot 6.

Figure 2:
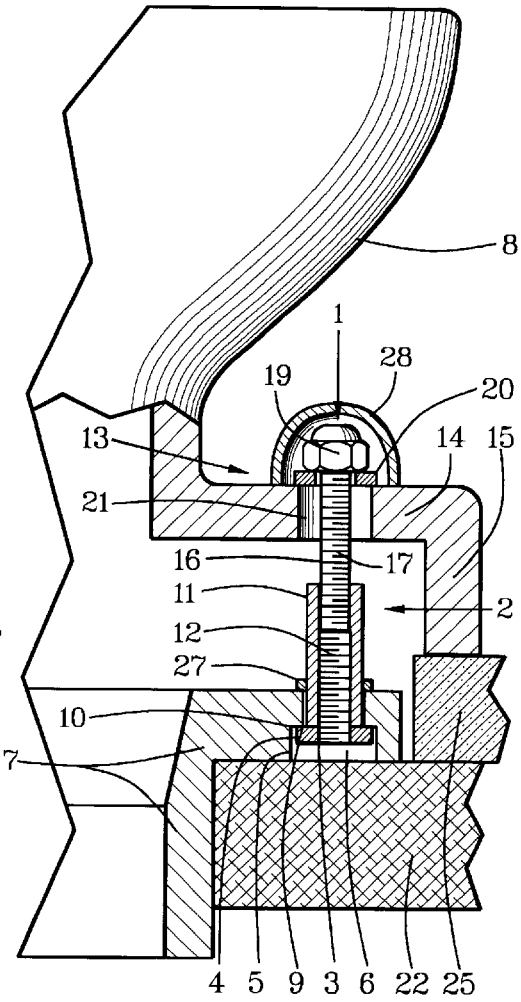
FIG. 2 is a partially cutaway front view of a right side of a fastening portion of a water closet such as a toilet bowl on a floor having thick flooring in relationship to an adjustable-length closet fastener adjusted in length for the thick flooring.
Figure 3:
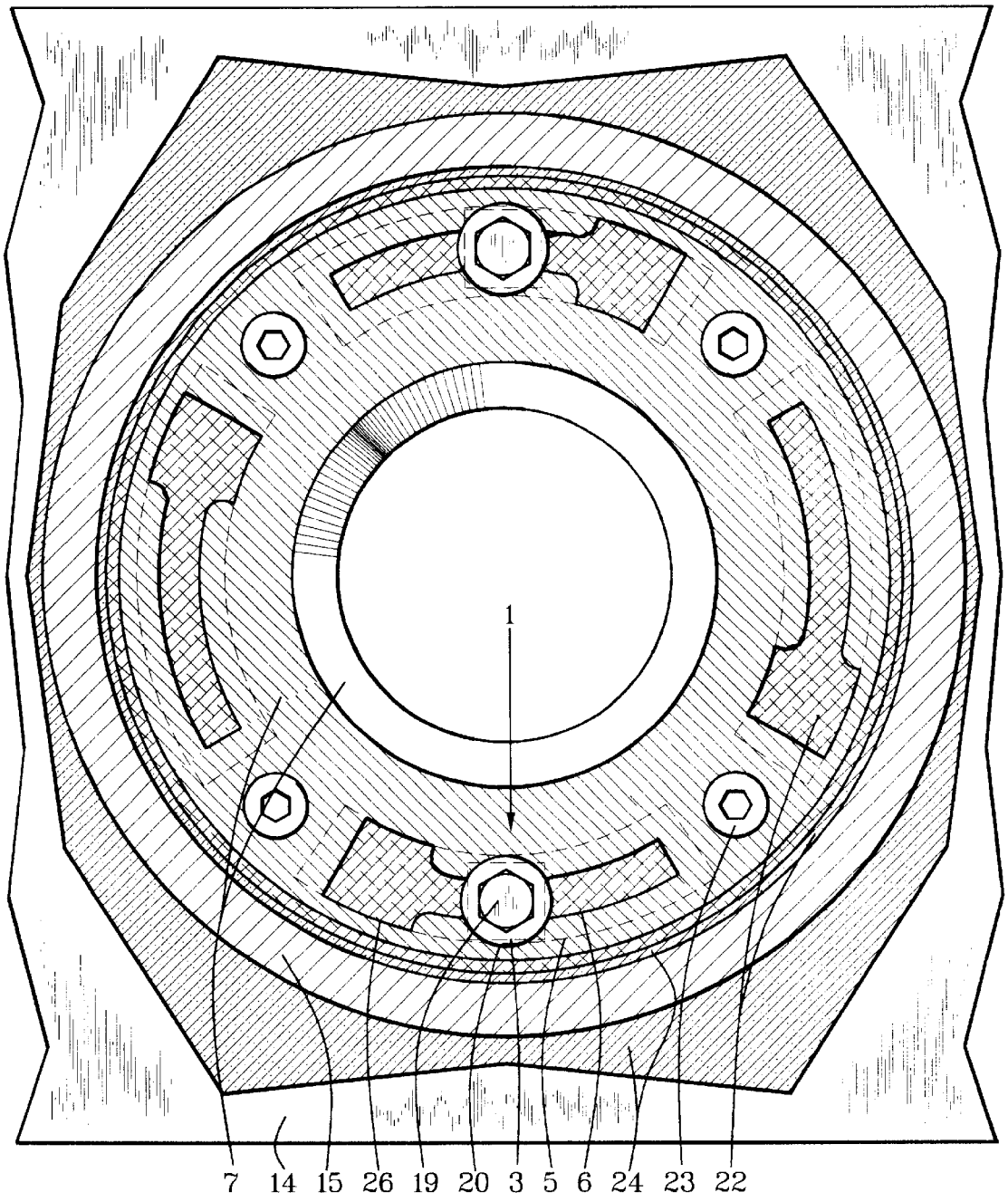
FIG. 3 is a partially cutaway top view of a fastening portion of a toilet bowl in relationship to adjustable-length closet fasteners.
Figure 4:
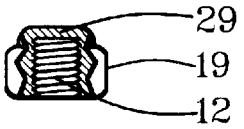
FIG. 4 is a partially cutaway side view of a fastener cap nut.
Figure 5:
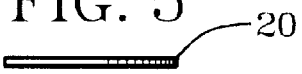
FIG. 5 is a side elevation view of a material-protection washer.
Figure 6:
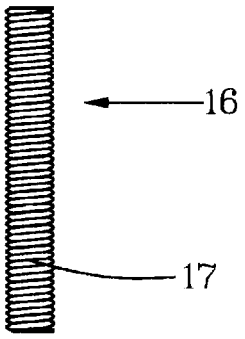
FIG. 6 is a side elevation view of a length-adjustment bolt.
Figure 9:
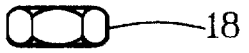
FIG. 9 is a side view of a fastener nut without a cap.

A length-adjustment sleeve 11 having internal machine threads 12 is extended from the fastener shank 2 for a predetermined distance towards a fastening position 13 proximate a top of a closet base 14 that is supported by a closet-base sleeve 15. A length-adjustment bolt 16 having external machine threads 17 that match the internal machine threads 12 of the length-adjustment sleeve 11 is screwed a desired length-adjustment distance into the length-adjustment sleeve 11. For maximum length adjustment of the adjustable-length closet fastener 1, a fastener nut 18 as depicted in FIGS. 1 and 9 or a fastener cap nut 19 as depicted in FIGS. 2–4 is screwed onto the length-adjustment bolt 16 on top of a material-protection washer 20. The fastener nut 18 or the fastener cap nut 19 is then rotated for desired fastening tightness intermediate the anchor-ridge head 3 and the fastener nut 18 or the fastener cap nut 19. The material-protection washer 20 also arrests entry of the fastener nut 18 or the fastener cap nut 19 into a closet-base aperture 21 through which the length-adjustment bolt 16 and/or the length-adjustment sleeve 11 are extended as variable-length portions of the adjustable-length closet fastener 1.

The mating flange 7 is attached to a floor 22 with flange bolts 23 represented by tops of flathead socket bolts in FIG. 3. The closet base 14 is then attached to the mating flange 7 with the adjustable-length closet fasteners 1 being adjusted in length to accommodate relatively thin flooring 24 depicted in FIG. 1 or relatively thick flooring 25 depicted in FIG. 2 intermediate the floor 22 and a bottom edge of the closet-base sleeve 15. The floor 22 is visible through the bolt-shaft slot 6 in FIG. 3.

The anchor-ridge heads 3 are inserted downwardly into the bolt-shaft slot 6 through flange-inlet bays 26 in ends of the bolt-shaft slots 6. In order to position the adjustable-length closet fastener vertically, a flange-lock ridge 27 is extended laterally in contact with a top surface of the mating flange 7.

After rotating the fastener nut 18 or the fastener cap nut 19 on the length-adjustment bolt 16 for fastener tightening, aesthetic covers 28 are placed over them and adhered to them and to the top of the closet base 14 with appropriate adherence material. There is no excess length as is the case with a conventional fastener shank to cut off before positioning of the aesthetic covers 28. Consequently, less time is consumed in installing water closets 8 and there is no risk of destroying a seal with the floor 22, dislodging bolts from mating flange 7 or cracking the mating flange 7.

Referring to FIGS. 1–8, fastener cap nut 19, the material-protection washer 20, the length-adjustment bolt 16 and the length-adjustment sleeve 11 having an anchor-ridge head 3 and a flange-lock ridge 27 described in relation to FIGS. 1–3 are shown disassembled in FIGS. 4–8. Internal machine threads 12 and external machine threads 17 are depicted graphically in FIGS. 4 and 6–7 instead of figuratively as in FIGS. 1–2. In FIG. 4, a closed end 29 is shown on a top of the fastener cap nut 19.

To use the embodiment depicted and described in relation to FIGS. 1 and 4–8, the fastener cap nut 19 can be screwed snugly onto a top end of the length-adjustment bolt 16 either before or after the length-adjustment bolt 16 is screwed into the length-adjustment sleeve 11.

Figure 7:
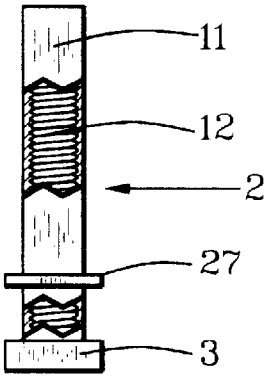
FIG. 7 is a partially cutaway side elevation view of a fastener shaft having an attached length-adjustment sleeve with an outside periphery that is rectangular.
Figure 8:
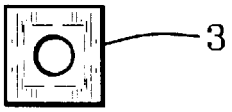
FIG. 8 is a bottom view of the FIG. 7 illustration.
Figure 10:
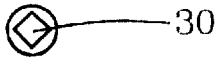
FIG. 10 is a top view of a length-adjustment bolt having a square grasp-handle extension.
Figure 11:
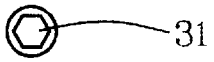
FIG. 11 is a top view of a length-adjustment bolt having a hexagonal grasp-handle extension.
Figure 12:
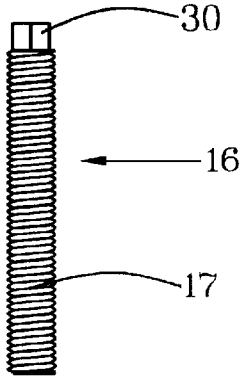
FIG. 12 is a side elevation view of a length-adjustment bolt having a square grasp-handle extension.
Figure 13:
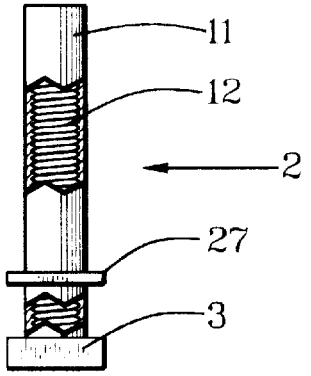
FIG. 13 is a partially cutaway side elevation view of a fastener shaft having an attached length-adjustment sleeve with an outside periphery that is circular.

Referring to FIGS. 1 and 9–13, the length-adjustment bolt 16 can have a square grasp-handle extension 30 as shown in FIGS. 10 and 12 or an otherwise polyhedral grasp-handle extension such as a hexagonal grasp-handle extension 31 such as depicted in FIG. 11 for manual rotation of the length-adjustment bolt 16 in the length-adjustment sleeve 11 prior to rotational tightening of the adjustable-length closet fastener 1. The adjustable-length sleeve 11 can be square as depicted in FIG. 7 or circular as depicted in FIG. 13.

Referring to FIGS. 14–22, the length-adjustment sleeve 11 can be affixed to and, therefore, an integral part of the fastener shank 2 as shown in FIGS. 1–2, 7 and 13. Optionally, the length-adjustment sleeve 11 can be a detachable extension as shown in FIGS. 14, 17, 20 and 22. For a length-adjustment sleeve 11 that is a detachable extension, a separable fastener shank 32 can be attachable to the length-adjustment sleeve 11 with external machine threads 17 that match the internal machine threads 12 of the length-adjustment sleeve 11. A rotation-arrestment head 33 having a desired shape can be attached to the separable fastener shank 32 as an option to the anchor-ridge head 3 described in relation to FIGS. 1–2, 7 and 13.

Figure 14:
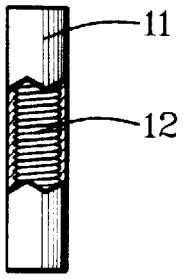
FIG. 14 is a partially cutaway side elevation view of a circular length-adjustment sleeve that is attachable to a fastener shaft.
Figure 15:
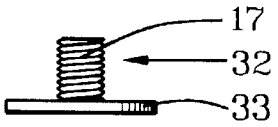
FIG. 15 is a side elevation view of a fastener shaft to which a length-adjustment sleeve is attachable.
Figure 16:
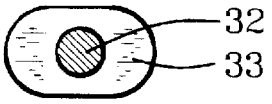
FIG. 16 is a top view of the FIG. 15 illustration.
Figure 17:
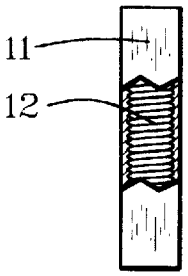
FIG. 17 is a partially cutaway side elevation view of a rectangular length-adjustment sleeve that is attachable to a fastener shaft.
Figure 18:
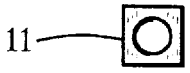
FIG. 18 is a top view of the FIG. 17 illustration.
Figure 20:
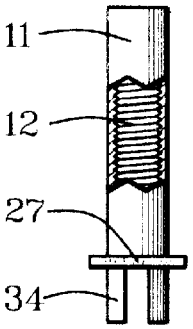
FIG. 20 is a partially cutaway side elevation view of a circular length-adjustment sleeve that is attachable to a fastener shaft and has a flange-lock ridge in addition to rotation-arrestment appendages.
Figure 21:
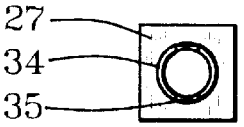
FIG. 21 is a bottom view of the FIG. 20 illustration.
Figure 22:
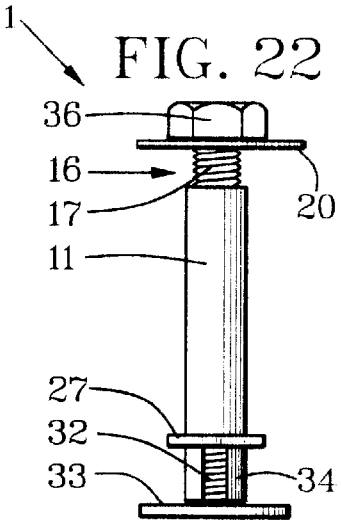
FIG. 22 is a side elevation view of an assembled adjustable-length closet fastener having a length-adjustable sleeve that is attachable to a fastener shank.

The outside periphery of the length-adjustment sleeve 11 that is a detachable extension can be circular as depicted in FIGS. 14, 20 and 22 or rectangular as depicted in FIGS. 17–18. Rectangular length-adjustment sleeves 11 can be sized and shaped to arrest rotation by contact with walls 5 of a bolt-shaft slot 6 described in relation to FIGS. 1–3. Optionally, length-adjustment sleeves 11 that are circular can have at least one rotation-arrestment appendage 34 extended from a bottom end and having at least one flat side 35 as depicted in FIGS. 20–22. Further optional for length-adjustment sleeves 11 that are detachable extensions can be flange-lock ridges 27 that are described in relation to FIGS. 1–2, 7 and 13.

Figure 19:
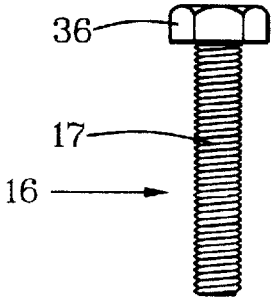
FIG. 19 is a side elevation view of a length-adjustment bolt with a fixed bolt head.

The length-adjustment bolt 16 can have a rigid bolt head 36 as depicted in FIGS. 19 and 22 for applications not requiring the additional length adjustment made possible by the fastener nut 18 described in relation to FIGS. 1 and 9 or made possible to a lesser extent by the fastener cap nut 19 described in relation to FIGS. 2 and 4.

Figure 23:
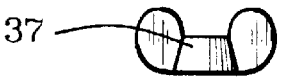
FIG. 23 is a side view of a wing nut that can be employed as a hand nut.

Referring to FIG. 23, a hand nut such as wing nut 37 can be employed as an option to the fastener nut 18 described in relation to FIG. 9, to the fastener cap nut 19 described in relation to FIG. 4 or to the rigid bolt head 36 described in relation to FIGS. 19 and 22 for particular use conditions.

To use the adjustable-length closet fastener 1 of this invention, a fastener shank 2 or optionally a separable fastener shank 32 with a length-adjustment sleeve 11 is positioned in a bolt-shaft slot 6 in a mating flange 7 for a water closet 8 with walls of the anchor ridge 3 or of the rotation-arrestment head 33 positioned against walls 5 of the bolt-shaft slot 6. A length-adjustment bolt 16 is screwed into the length-adjustment sleeve 11. Surfacing material with thickness ranging from the relatively thin flooring 24 to the relatively thick flooring 25 and a closet base 14 with a likely closet base sleeve 15 are positioned over the mating flange 7 while the fastener shank 2 or 32 is extended beyond the surfacing material through a closet-base aperture 21 in the closet base 14. Length of the adjustable-length closet fastener 1 is adjusted by screwing the length-adjustment bolt 16 into the length-adjustment sleeve 11 a distance which establishes a fastening length of the length-adjustment bolt 16 intermediate the anchor-ridge head 3 or the rotation-arrestment head 33 and the fastening position 13.

For a fastener shank 2 having a flange-lock ridge 27, retainment wall 10 of the retainment cavity such as the bolt-shaft slot 6 is positioned intermediate the flange-lock ridge 27 and the anchor-ridge head 3 for linear containment of the fastener shank 2 or 32, the length-adjustment sleeve 11 and, consequently, the length-adjustment bolt 16 which has a top end with fastener components such as a fastener nut 18, a fastener cap nut 19, a rigid bolt head 36 or a wing nut 37.

The aesthetic cover 28 is then positioned over a tip of the length-adjustment bolt 16 that does not have excess bolt length to be cut off after setting a water closet.

A new and useful adjustable-length closet fastener and method having been described, all such foreseeable modifications, adaptations, substitutions of equivalents, mathematical possibilities of combinations of parts, pluralities of parts, applications and forms thereof as described by the following claims and not precluded by prior art are included in this invention.

what is claimed is:

1. An adjustable-length closet fastener comprising:

a fastener shank having an anchor-ridge head which is sized and shaped for positioning at least one side wall of the anchor-ridge head against at least one wall of a predetermined retainer cavity to arrest shaft rotation and which is sized and shaped for positioning a fastener shank-side surface of the anchor-ridge head against a retainment wall of the predetermined retainer cavity at sides of a shaft slot in the predetermined retainer cavity to prevent exit of the adjustable-length closet fastener from the predetermined retainer cavity;

a length-adjustment sleeve having internal machine threads and extended from the fastener shank for a predetermined distance towards a predetermined fastening position wherein the length-adjustment sleeve has an integral flange-lock ridge positioned a distance from the anchor-ridge head to receive anchor walls of a closet anchor intermediate the flange-lock ridge and the anchor-ridge head;

a length-adjustment bolt having external machine threads that match the internal machine threads of the length-adjustment sleeve;

the length-adjustment bolt being screwed a desired length-adjustment distance into the length-adjustment sleeve and tightened intermediate the anchor-ridge head and the predetermined fastening position proximate a top end of the length-adjustment bolt; and a retainer proximate a top end of the length adjustment bolt.

2. An adjustable-length closet fastener as described in claim 1 wherein:

the length-adjustment sleeve is a rigid extension of the fastener shank.

3. An adjustable-length closet fastener as described in claim 2 wherein:

the length-adjustment sleeve has a rectangular outside periphery.

4. An adjustable-length closet fastener as described in claim 1 wherein:

the length-adjustment sleeve is a detachable extension of the fastener shank.

5. An adjustable-length closet fastener as described in claim 1 wherein:

the fastener shank has external machine threads;

the length-adjustment sleeve is a detachable extension of the fastener shank; and the length-adjustment sleeve has internal machine threads that match the external machine threads of the fastener shank.

6. An adjustable-length closet fastener as described in claim 5 wherein:

the length-adjustment sleeve has at least one rotation-arrestment appendage extended from the length-adjustment sleeve into the shaft slot to arrest rotation of the shaft sleeve in opposition to rotation of the length-adjustment bolt in the length-adjustment sleeve.

7. An adjustable-length closet fastener as described in claim 1 wherein:

the predetermined retainer cavity for which the anchor-ridge head is sized and shaped is a bolt-shaft slot in a mating flange for a water closet.

8. An adjustable-length closet fastener comprising:

a fastener shank having an anchor-ridge head which is sized and shaped for positioning of sides of the anchor-ridge head against walls of a bolt-shaft slot in a mating flange for a water closet to arrest shaft rotation and which is sized and shaped for positioning a fastener shank-side surface of the anchor-ridge head against a retainment wall proximate the bolt-shaft slot to prevent exit of the adjustable-length closet fastener from the bolt-shaft slot;

a length-adjustment sleeve having internal machine threads and extended from the fastener shank for a predetermined distance towards a predetermined fastening position wherein the length-adjustment sleeve has an integral flange-lock ridge on the fastener shank positioned at a distance from the anchor-ridge head which allows insertion of a retainment wall of the retainer cavity intermediate the flange-lock ridge and the anchor-ridge head;

a length-adjustment bolt having external machine threads that match the internal machine threads of the length-adjustment sleeve;

the length-adjustment bolt being screwed a desired length-adjustment distance into the length-adjustment sleeve and tightened intermediate the anchor-ridge head and the top of the length-adjustment bolt; and a retainer proximate a top end of the length adjustment bolt.

9. An adjustable-length closet fastener as described in claim 8 wherein:

the length-adjustment sleeve is a rigid extension of the fastener shank;

the length-adjustment sleeve has an anchor ridge positioned a distance from the anchor-ridge head to receive anchor walls of a closet anchor flange intermediate the anchor ridge and the anchor-ridge head.

10. An adjustable-length closet fastener as described in claim 8 wherein:

the length-adjustment sleeve is a detachable extension of the fastener shank.

11. An adjustable-length closet fastener as described in claim 8 wherein:

the fastener shank has external machine threads;

the length-adjustment sleeve is a detachable extension of the fastener shank; and the length-adjustment sleeve has internal machine threads that match the external machine threads of the fastener shank.

12. An adjustable-length closet fastener as described in claim 11 wherein:

the length-adjustment sleeve has at least one rotation-arrestment appendage extended from the length-adjustment sleeve into the shaft slot to arrest rotation of the shaft sleeve in opposition to rotation of the length-adjustment bolt in the length-adjustment sleeve.

13. An adjustable-length closet fastener as described in claim 1 wherein the retainer comprises:

a fastener nut on the top end of the length-adjustment bolt.

14. An adjustable-length closet fastener as described in claim 13 and further comprising:

a grasp-handle extension on an end of the length-adjustment bolt for manual rotation of the length-adjustment bolt in the length-adjustment sleeve prior to rotational tightening of the adjustable-length closet fastener intermediate the anchor-ridge head and the fastening position.

* * * * *